US005444790A

United States Patent [19]

Kogen

[11] Patent Number: 5,444,790

[45] Date of Patent: Aug. 22, 1995

[54] MICROPHONE WINDSCREEN MOUNTING

[75] Inventor: James H. Kogen, Wilmette, Ill.

[73] Assignee: Shure Brothers, Inc., Evanston, Ill.

[21] Appl. No.: 203,322

[22] Filed: Feb. 28, 1994

[51] Int. Cl.[6] ..... H04R 25/00

[52] U.S. Cl. ..... 381/168; 381/169; 381/189

[58] Field of Search ..... 381/168, 169, 188, 205, 381/189; 181/242; 220/379

[56] References Cited

U.S. PATENT DOCUMENTS

| | | | |
|---|---|---|---|
| 2,520,706 | 8/1950 | Anderson et al. . | |
| 2,623,957 | 12/1952 | Gragg et al. . | |
| 4,319,097 | 3/1982 | Liautaud | 381/169 |
| 4,570,746 | 2/1986 | Das et al. | 181/242 |
| 4,964,161 | 10/1990 | Trowbridge, Jr. . | |
| 5,107,580 | 4/1992 | Watanabe . | |
| 5,144,677 | 9/1992 | Asakura et al. | 381/169 |
| 5,224,620 | 7/1993 | Nyorkor et al. | 220/379 |

*Primary Examiner*—Wing F. Chan
*Assistant Examiner*—Sinh Tran
*Attorney, Agent, or Firm*—Banner & Allegretti, Ltd.

[57] ABSTRACT

A mounting for detachable securing a windscreen to a microphone includes a magnetic ring on one of the windscreen or microphone and a complementary steel ring on the other of the windscreen or microphone. A plastic ring is provided to hold the magnetic ring. The magnetic engagement between the magnetic ring and the steel ring will permit firm coupling of the windscreen and microphone in use. The mounting permits easy disengagement in the event the windscreen is not needed, or to permit maintenance or repair of the microphone. The plastic ring is retained on the microphone between the body and the head, which are interconnected by complementary threads on the exterior of the body/head and the interior of the other of the head/body.

12 Claims, 1 Drawing Sheet

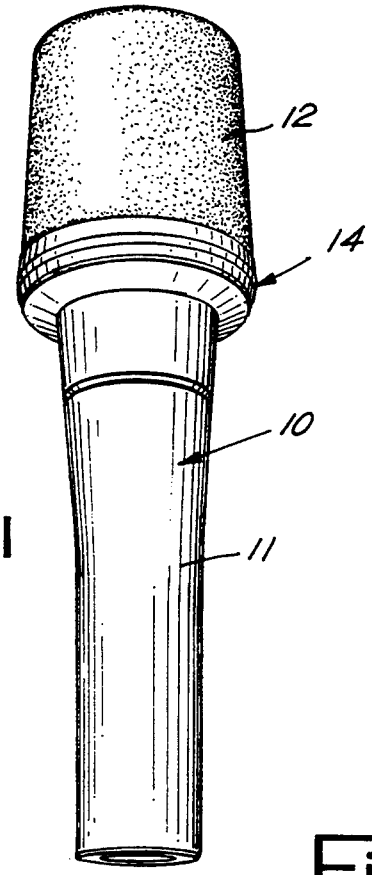
Fig. 1
Fig. 2
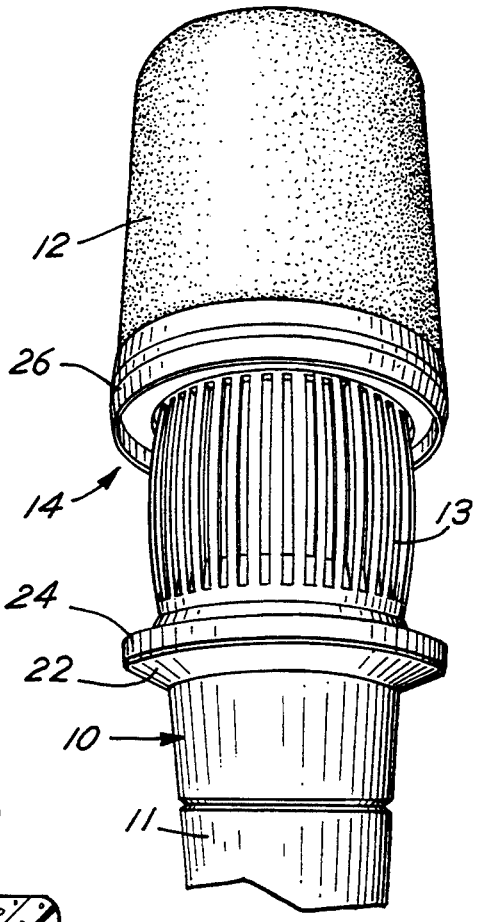
Fig. 3
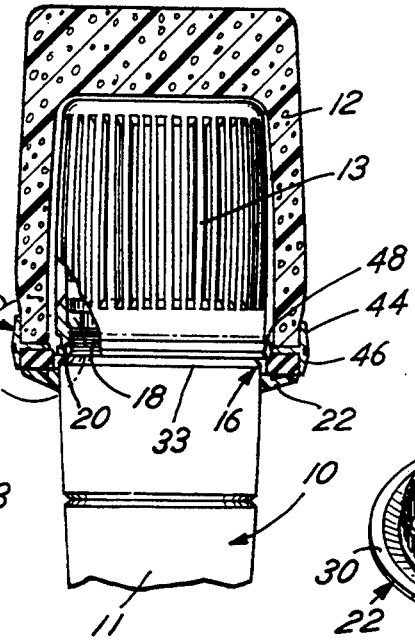
Fig. 4
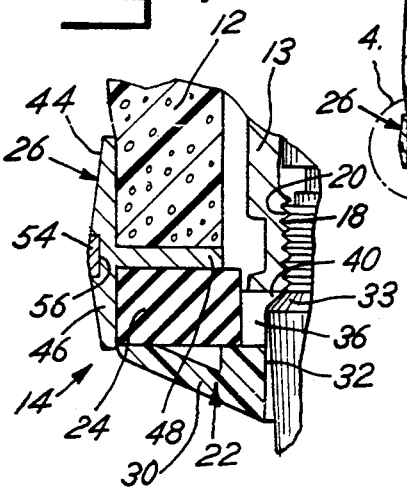
Fig. 5
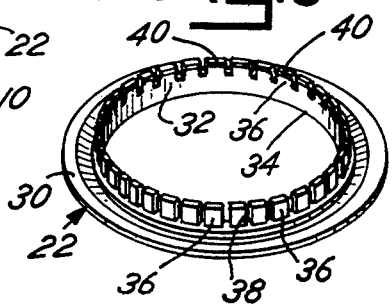

MICROPHONE WINDSCREEN MOUNTING

BACKGROUND OF THE INVENTION

The present invention relates to microphones and, more particularly, to an arrangement for detachably securing a windscreen to a microphone in a simple and relatively inexpensive fashion.

The prior art shows various arrangements for providing a windscreen on a microphone. Anderson et al. U.S. Pat. No. 2,520,706 shows a compound screen surrounding a cylinder containing a pair of microphones. Cragg et al. U.S. Pat. No. 2,623,957 reveals a microphone shield comprising a screen and a hemispherical block of fine elements secured to a microphone by a spring clamp ring. Das et al. U.S. Pat. No. 4,570,746 pertains to a windscreen for a microphone, the windscreen comprising hemispherical sections pivoted with respect to each other and secured over the microphone by a rubber grommet on a connecting element. These arrangements for securing or affixing a windscreen on a microphone are fairly complicated.

An object of the present invention is to provide a detachable mounting means for detachably securing a windscreen to a microphone in a simple, reliable fashion.

Another object of the present invention is to provide magnetic mounting means for detachably securing a windscreen to a microphone in a secure fashion without the need for tools. Other objects and advantages of the present invention will be made more apparent hereinafter.

SUMMARY OF THE INVENTION

This invention pertains to a mounting for detachably securing a windscreen to a microphone. The mounting comprises a magnetic ring or magnetic segments on either of the windscreen or the microphone and a complementary steel ring on the other of the windscreen or microphone. A plastic mounting ring is provided to hold the magnetic ring or magnetic segments and secure same in position on the windscreen or the microphone. The magnetic engagement between the magnetic ring or magnetic segments and the steel ring will permit firm coupling of the windscreen and microphone in use. In a preferred arrangement the plastic ring for holding the magnetic ring is adapted to be affixed to the microphone and the steel ring is affixed to the windscreen. The mounting of this invention permits easy engagement and simple disengagement of the windscreen from the microphone in the event the windscreen is not needed, or to permit maintenance or repair of the microphone or windowscreen.

BRIEF DESCRIPTION OF THE DRAWING

There is shown in the attached drawing a presently preferred embodiment of the present invention wherein like numerals in the various views refer to like elements and wherein:

FIG. 1 is a perspective elevational view showing a windscreen mounted on a microphone;

FIG. 2 is a perspective elevational view similar to FIG. 1, illustrating the windscreen partially removed from its use position, i.e., with the mounting means disengaged;

FIG. 3 is a cross sectional view of the windscreen, better showing the mounting means engagement with the microphone;

FIG. 4 is a detail view of the mounting means of the present invention taken in the area within a circle marked 4 in FIG. 3; and FIG. 5 is a perspective view of the mounting ring which is a part of the mounting means that it is adapted to be secured to the microphone.

DETAILED DESCRIPTION OF THE PRESENT INVENTION

There is shown in FIGS. 1 and 2, a microphone 10 provided with a windscreen 12 that is detachably connected to the microphone by a novel mounting means 14. The microphone 10 may be a conventional microphone made by Shure Brothers Incorporated of Evanston, Ill. Basically, the microphone 10 includes a body 11 joined to a head 13 by complementary threaded means 16. As shown in FIG. 3 and 4, the body 11 may have external threads 18 and the head 13 may have internal threads 20 that cooperate with the threads 18 to engage the head 13 to the body 11. The windscreen 12 basically comprises a foam cup-shaped member closed at one end and open at the other. Preferably, the windscreen 12 is made from polyester urethane fully articulated foam having 80±10 pores per inch. The windscreen 12 functions to sharply reduce wind and air gust noises outdoors and provide extra "pop" protection for close talking applications.

The mounting means 14 comprises an annular ring 22 carried on and adapted to be engaged by the microphone, a magnetic ring 24 secured to the annular ring 22 and an annular ferrous ring 26 joined to the windscreen 12 adjacent the open end thereof.

The ring 22 (FIGS. 4–5) is made from plastic, for example, ABS (acrilonitrile-butadiene-styrene). The base portion 30 of the ring 22 has a wall 32 defining an opening 34. The opening 34 is adapted to receive the microphone housing or body 11. Extending upwardly from the base portion 30 are a plurality of projections 36 each separated from one another by a slot 38 and each having an enlargement 40 on the upper end thereof facing inwardly. The projections 36 are in effect cantilevered from the base portion 30 and have inherent resiliency. The enlargements 40 of the projections 36 will engage the exterior sloping surface 33 of the microphone 10 (which surface defines a detented recess) and help fix the ring 22 to the microphone when the head 13 is fully engaged with the body 11 as the projections 36 engage in the dented recess 33 on the microphone base, between the head 13 and the body 11. These projections 36 may also provide friction to hold the ring 22 to the microphone in situations where there is minimal or no detented recess on the microphone base.

The magnetic ring 24 may be made from a flexible rubber slab ( or ring) containing a magnetic ring or magnetic segments or particles. Preferably the magnetic ring 24 is bonded to the ring 22, for example, by a suitable adhesive as shown in FIG. 4. The magnetic ring 24 and the ring 22 comprise annuler magnetic ring means.

The ring or adaptor 26 is preferably made from a ferrous material, such as cold rolled steel and is suitably connected to the windscreen 12, for example, by a suitable adhesive as shown in FIG. 4. The ring 26 includes an annular portion 44 adapted to engage and be affixed to the windscreen 12, an annular portion 46 that is generally complementary to the exterior of the magnetic ring 24 and a generally radially extending portion 48. A decor ring 54 may be provided in the recess 56 in the ring or adaptor 26.

To use the mounting means 14, the head 13 is removed from the body 11. The mounting means 14 are positioned on the body 11 with the wall 32 contacting the exterior surface of body 11 and the enlargements on the projections 36 engaging the sloping surface 33 on body 11. The head 13 is threaded onto the body 11 to hold the annular ring 22 in place. The windscreen 12 is placed over the microphone 10 and the lower end thereof is moved toward the annular ring 22 which is secured on the microphone 10. The lower annular portion 46 of the ring 26 and the radial portion 48 thereof will come into proximity of the magnetic ring 24 and be engaged thereby to firmly seat the windscreen 12 on the microphone 10. The magnetic mounting means are sufficiently strong to enable the windscreen and microphone to be used in difficult environments and conditions.

When it is desired to remove the windscreen 12 from the microphone 10, the user grips the ring 26 in one hand and the microphone 10 in the other hand and pulls the two hands apart. The ring 26 is easily separated from the magnetic ring 24 without the need for any tools.

There has been provided by the present invention a simple, relatively inexpensive mounting for a windscreen on a microphone, which requires no tools for assembly or disassembly of the windscreen with respect to the microphone. The windscreen can be slipped over the head of the microphone and readily retained in use position by engagement of ring 26 with the magnetic ring 24. The peripheral portion of the ring 26 is complementary to the ring 24 and engages same.

The radial portion 48 of the ring 26 engages the top surface of the magnetic ring 24 on the exterior perimeter surface. The complementary interengagement of magnetic ring 24 and ring 26 provide a very stable connection of the windscreen 12 on the microphone 10. The microphone 10 can be used in hard conditions, for example, by a very active, dynamic performer, with little fear that the windscreen will become separated from the microphone. Yet, separation of the windscreen from the microphone can be easily accomplished without tools, when desired, by urging the rings 24 and 26 apart with movement of the hands in opposite directions.

There has been shown and described a presently preferred embodiment of the invention. Numerous modifications will be apparent to persons skilled in the art. It is understood that the appended claims are intended to cover all such modifications and changes as fall within the true spirit and scope of the invention.

I claim:

1. A mounting device for detachably securing a windscreen to a microphone comprising annular magnetic ring means adapted to be secured to said microphone and said windscreen having an open end, ferrous ring means secured adjacent said open end of said windscreen, said ferrous ring means being complementary in shape to said annular magnetic ring means and cooperating with said annular magnetic ring means to enable detachable connection of said windscreen to said microphone; said annular magnetic ring means including an annular non-ferrous resilient ring and at least one magnet secured thereto, said annular non-ferrous resilient ring including a base portion and projections extending therefrom for engaging and holding the annular resilient ring on the microphone.

2. The mounting device as in claim 1 wherein said magnet is a permanent magnet.

3. The mounting device as in claim 1 wherein said ferrous ring means comprises a steel ring.

4. The mounting device as in claim 1 where said ferrous ring means comprises a peripheral portion and a radial portion, said peripheral portion and said radial portion engaging said annular magnetic ring means when the windscreen is engaged on the microphone.

5. The mounting device as in claim 1 wherein the ferrous ring means comprises a first annular portion adapted to engage and be affixed to the windscreen, a second annular portion generally complementary to the exterior of the annular magnetic ring means and adapted to cooperate therewith in use, and a radially extending portion between the first annular portion and the second annualar portion for cooperating with a surface of the annular magnetic ring means.

6. The mounting device as in claim 5 wherein the second annular portion and the radially extending portion of the ferrous ring means engage the annular magnetic ring means.

7. The mounting device as in claim 1 wherein the projections have enlargements on the free ends thereof.

8. A mounting device for detachably securing a windscreen to a microphone comprising annular magnetic ring means adapted to be secured to said microphone between the head and body thereof and said windscreen having an open end, ferrous ring means secured adjacent said open end of said windscreen, said ferrous ring means being complementary in shape to said annular magnetic ring means and cooperating with said annular magnetic ring means to enable detachable connection of said windscreen to said microphone and an annular plastic ring having a base portion supporting said annular magnetic ring means and projections extending therefrom, said projections having enlargements on the free ends thereof engaging said body of the microphone for retaining the annular plastic ring and the annular magnetic ring means in position on said microphone.

9. A mounting device as in claim 8 where said ferrous ring means comprises a peripheral portion and a radial portion, said peripheral portion and said radial portion engaging said annular magnetic ring means when the windscreen is engaged on the microphone.

10. A mounting device as in claim 8 wherein the ferrous ring means comprises a first annular portion adapted to engaged and be affixed to the windscreen, a second annular portion generally complementary to the exterior of the annular magnetic ring means and adapted to cooperate therewith in use, and a readily extending portion between the first annular portion and the second annular portion for cooperating with a surface of the annular magnetic ring means.

11. A mounting device structure for detachably securing a windscreen to a microphone comprising an annular non-ferrous resilient ring adapted to be secured to said microphone, a magnet secured to said annular non-ferrous resilient ring, said windscreen having an open end, and a ferrous ring complementary in shape to said annular non-ferrous resilient ring and cooperating with said annular non-ferrous resilient ring to enable detachable connection between said windscreen and said microphone, said ferrous ring comprising a first annular portion adapted to engage and be affixed to the windscreen, a second annular portion generally complementary to the exterior of the annular non-ferrous resilient ring and adapted to cooperate therewith in use, and a radially extending portion between the first annular portion and the second annular portion for cooperating with a surface of the annular non-ferrous resilient ring, the second annular portion and the radially extending portion of the ferrous ring engaging the annular non-ferrous resilient ring, said annular non-ferrous resilient ring including a base portion and projections extending therefrom for engaging and holding the annular non-ferrous resilient ring on said microphone.

12. Mounting structure as in claim 11 wherein each projection has an enlargement on the free end thereof for engaging the microphone.

* * * * *